US007066828B2

(12) United States Patent
Lee et al.

(10) Patent No.: US 7,066,828 B2
(45) Date of Patent: Jun. 27, 2006

(54) GOLF TRAINING MACHINE

(76) Inventors: Dong Ho Lee, 101-1802 Kyungnam Apt., Shingil-1 Dong, Youngdeungpo-Gu, Seoul (KR); Jin Ho Lee, 101-1802 Kyungnam Apt., Shingil-1 Dong, Youngdeungpo-Gu, Seoul (KR)

( * ) Notice: Subject to any disclaimer, the term of this patent is extended or adjusted under 35 U.S.C. 154(b) by 0 days.

(21) Appl. No.: 11/033,628

(22) Filed: Jan. 13, 2005

(65) Prior Publication Data

US 2005/0159234 A1 Jul. 21, 2005

(30) Foreign Application Priority Data

Jan. 19, 2004 (KR) ..... 10-2004-0004014

(51) Int. Cl.
*A63B 69/36* (2006.01)

(52) U.S. Cl. ..... 473/277; 473/266; 473/271

(58) Field of Classification Search ..... 473/207, 473/215–218, 266–277
See application file for complete search history.

(56) References Cited

U.S. PATENT DOCUMENTS 3,215,438 A * 11/1965 Sheldon et al. ..... 473/277
5,125,663 A * 6/1992 Lurowist, Jr. ..... 473/216
5,288,074 A * 2/1994 Scheurer ..... 473/277
5,830,079 A * 11/1998 Hudson ..... 473/272
5,916,037 A * 6/1999 Hill ..... 473/277
5,984,797 A * 11/1999 Kessler et al. ..... 473/216

* cited by examiner

*Primary Examiner*—Nini F. Legesse
(74) *Attorney, Agent, or Firm*—Antonelli, Terry, Stout and Kraus, LLP.

(57) ABSTRACT

A golf training machine for correcting the posture for addressing a golf ball and the golfer's swing is disclosed. The machine includes a supporting body including a flat plate and pillar vertically inserted and arranged on the plate, a pivot arm which is rotatably at one end around a shaft at an upper end of the pillar, a support rotatably attached at another end of the pivot arm for performing rotation of the hips of a golfer and an auxiliary support located at one side of the front of the pivot arm for supporting a side of the hips of the golfer.

3 Claims, 7 Drawing Sheets

GOLF TRAINING MACHINE

CROSS-REFERENCE TO RELATED APPLICATION

This application claims the benefit of Korean Patent Application No. 2004-4014, filed Jan. 19, 2004, the disclosure of which is hereby incorporated herein by reference in its entirety.

BACKGROUND OF THE INVENTION

1. Technical Field

The present invention relates to a golf training machine, and, more particularly, to a golf training machine for allowing repeated practice of addressing of the ball motion and swinging to correct the addressing and swinging posture, using a mechanical structure.

2. Discussion of the Related Art

Playing golf involves hitting a ball to a target position by swinging a club while maintaining a still state. Most importantly, a swing is acceptable if the head of the club does not go deviate from its desired track. A still posture such as a basic posture before hitting the ball, for example, gripping, addressing and stance, and a moving posture such as a swing based on the basic posture are considered to be the important points mentioned above.

Beginners or general golfers know well the required still posture to a certain extent but are unable during swinging to maintain the moving posture. That is, beginners or general golfers have a lot of difficulty in fully knowing how to perform a continuous and rhythmical swing motion involving back swing, down swing, impact, follow-through and finish.

Training to achieve a swing is well known through a professional or the literature. In this regard, the fact is that the diversified and indirect guidance of golf professions or the differences in learning according to the individual golfer does not provide consistent or standardized training.

For the beginner when consistent training is not performed, confusion occurs and as a result, the efficiency of the training decreases and it is impossible to accurately obtain the correct posture for addressing the ball or swinging.

In such a case, there is a problem that a hook or slice is caused by the unstable addressing of the ball and the swing, which is the main factor for inaccurate flight or poor distance.

SUMMARY OF THE INVENTION

Therefore, the present invention is directed to provide a golf training machine for repeatedly performing the addressing of the ball and swinging motions with proper mechanical form with a frame supporting the back of a human body. The hips of a golfer, are supported during rotation and revolution, thereby causing the addressing of the ball and swinging motion be remembered by the golfer so that the golfer knows the swinging motion and has posture correction.

Another object of the present invention is to provide a golf training machine for standardizing addressing of the ball and swinging training.

The objects of the present invention are achieved by a golf training machine for providing memory by the golfer of addressing the ball and swinging motion or correcting such golf posture. The machine comprises a loading board of a flat plate shape, a supporting body including a pillar vertically inserted into and arranged at an appropriate position on the loading board, a pivot arm freely and rotatably arranged to be revolved around one side of the upper end of the pillar as a shaft, a support freely and rotatably arranged to be rotated on the other end of the pivot arm, for supporting the hips of a golfer, and an auxiliary support of a wing shape arranged at one side of the front of the support, for supporting the side of the hips of the golfer, wherein a movement line through first, second, third and forth positions is formed by using the rotation of the support for supporting the hips of the golfer and the revolution of the pivot arm, thereby making possible for the golfer to repeatedly and consistently address the golf ball and perform swinging motions with posture correction, through use of the machine.

BRIEF DESCRIPTION OF THE DRAWINGS

The above and other features and advantages of the present invention will become more apparent to those of ordinary skill in the art by describing in detail preferred embodiments thereof with reference to the attached drawings in which:

FIGS. 4*a*, 4*b*, 4*c* and 4*d* are views illustrating respective motions of the golf training machine according to the present invention, wherein FIG. 4*a* is a view of a first position illustrating an addressing a ball; FIG. 4*b* is a view of a second position illustrating a backswing; FIG. 4*c* is a view of a third position during impact of the ball; and FIG. 4*d* is a view of a fourth position continued from impact with the ball to completion of the swing.

DETAILED DESCRIPTION OF THE INVENTION

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout the specification.

The characteristic technique of the present invention is not the training by indirect instructions from a golf professional but a golf training machine for directly and forcibly correcting the form and posture through a predetermined mechanical structure and making the human body learn motions through continued and repeated training, so that a golfer knows the correct addressing of the ball or swinging motion. As the most important point in the moving form and posture for swinging and still form and posture for the addressing of the ball is the movement line around the hips of the golfer, the present invention provides a golf training machine for facilitating the golfer to know the movement line at her/his hips.

Figure 1:
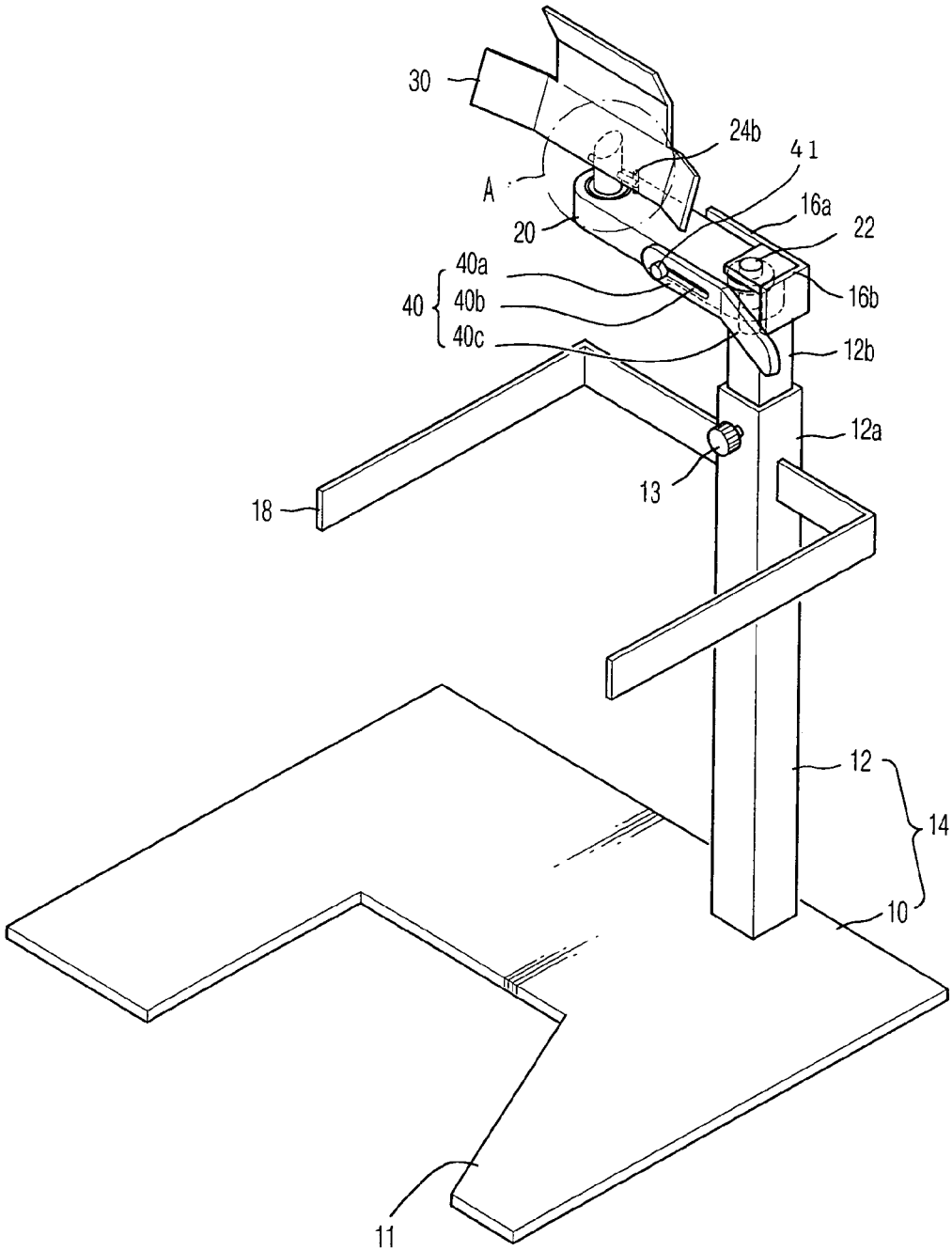
FIG. 1 is a perspective view illustrating a golf training machine according to the present invention.
Figure 2:
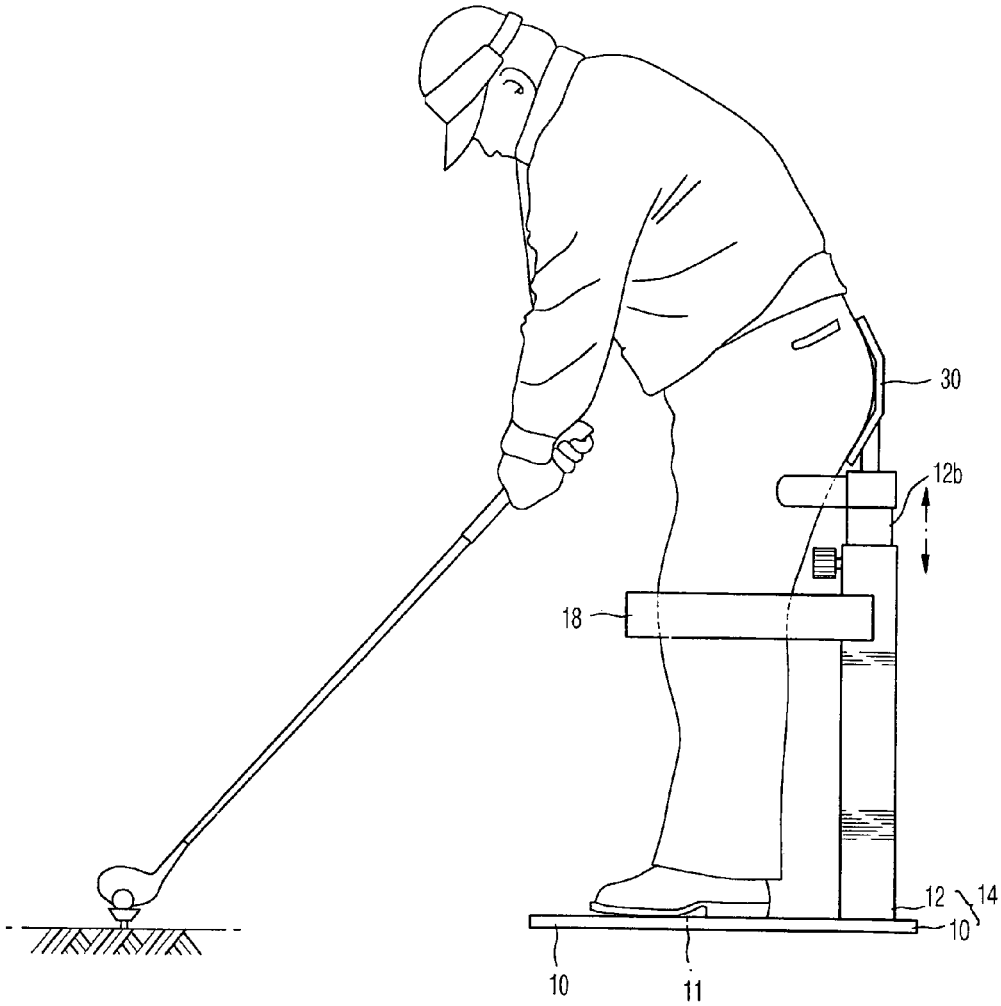
FIG. 2 is a view illustrating the use of the golf training machine according to the present invention.

FIG. 1 is a perspective view illustrating the whole structure of a golf training machine according to one embodiment of the present invention, and FIG. 2 is a view illustrating an example wherein the golf training machine according to the present invention is used. The golf training machine according to the present invention, which can be easily arranged for training at home, in a golf training practice place or at any place where an appropriate space is provided, comprises a loading board 10, a supporting body 14 with a pillar 12 which is vertically inserted and arranged at an appropriate position on the loading board 10; a pivot arm 20 for performing revolution, freely and rotatably arranged at one side of the upper end of the pillar 12 on the supporting body 14 around a shaft; a support 30 for supporting the hips of a golfer and performing rotation, arranged on the board at the other side of the pivot arm 20; and an auxiliary support 40 for supporting the side of the hips of the golfer, arranged at one side of the front of the pivot arm 20, wherein a movement line to first, second, third and fourth positions is performed, using the rotation of the support 30 for supporting the hips of the golfer and the revolution of the pivot arm 20, thereby providing the golfer with the ability to repeatedly practice and memorize the addressing of the ball and swinging motions through the mechanical structure of the invention while performing the posture correction.

More specifically, the supporting body 14 includes the loading board 10 in flat plate shape having an appropriate width for the golfer to stand on and posture as shown in the drawing; and the pillar 12. The loading board 10 is provided with a guidance element 11 for guiding a position for the golfer's right and left feet when addressing the ball and swinging. The left foot may have a more or less open angle. The guidance element 11 is formed by partially cutting the loading board 10 and may have another projection or may be marked by line.

Figure 3A:
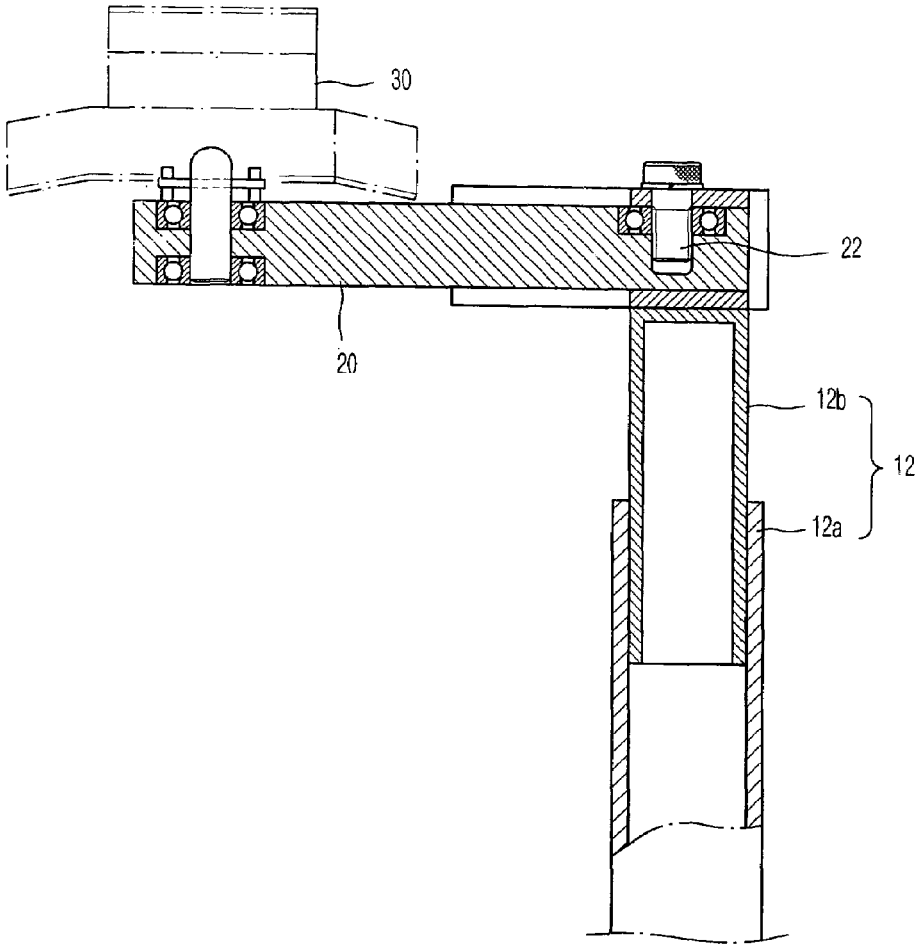
FIG. 3*a* is a side sectional view illustrating the structure of the golf training machine according to the present invention.
Figure 3B:
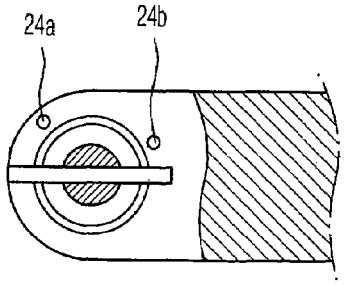
FIG. 3*b* is a partial enlarged plan view illustrating part "A" of FIG. 1.

In FIGS. 3*a* and 3*b*, the pillar 12 includes a first pipe member 12*a* and a second pipe member 12*b* which are separately formed with a square or cylindrical pipe shape, in which the second pipe member 12*b* is freely moved inward or outward so that the first pipe member 12*a* and the length of the second pipe member 12*b* is extended or contracted for freely controlling the height according to the golfer's physical constitution conditions. A control position of the second pipe member 12*b* is fixed by a binding member 13 formed by a screw and a bolt.

Further, the pivot arm 20, having a given length, is arranged at the upper end of the pillar 12, and is freely rotatable around a shaft 22 at one side, and the other side of the pivot arm 20 is provided with a support 30, which is I freely rotatable. The pivot arm 20 pivots within the limited range limited by a first stopper 16*a* and a second stopper 16*b*, which are at the upper end of the pillar 12. The pivot arm 20 longitudinally divides the body half in half, gathers the divided bodies, inserts or removes the divided bodies inward or outward, thereby controlling the length to be extended or contracted according to the golfer's physical characteristics.

The support 30 is freely rotated around the shaft 22 at the edge portion of the other end of the pivot arm 20. The support 30 is made of an injection molded material or non metallic material using appropriate plastics and is formed in a many-sided and diversified shape to cover and support the hips of the golfer. The support 30 may include a binding member using a band-shape or airbag by which the hips of the golfer are supported. The support 30 is pivotable through a limited motion limited by first and second brake pins 24*a*, 24*b* provided on the other end of the pivot arm 20, and an auxiliary support 40 having wing shape which is attached on one side of the front of the pivot arm 20 by the binding member 41, for supporting the side between the hips and the thigh of the golfer.

The auxiliary support 40 includes a supporting side 40*a* to be bound with the front of the pivot arm 20 which uses the binding member 41 for tightening up or loosening a screw or a bolt; and a holding side 40*c* which is integrally extended, at a predetermined length, to the supporting side 40*a* and includes a projection outward from the front surface of the pivot arm. The supporting side 40*a* includes a slot 40*c* for making it possible to control the position of the auxiliary support 40 according to the golfer's physical constitution.

A control bar 18 is provided at an appropriate position on the pillar 12, thereby limiting the movement of both knees of the golfer within a predetermined range. More specifically, the control bar 18 is formed to be of a narrow band shape and may be arranged to be fixed or controlled with respect to the height and to prevent the right knee of the golfer from being pushed or pulled backward. The control bar 18 further includes a holding bar 18*a* for preventing the right knee from being pushed backward.

The operative steps of the golf training machine according to the present invention are specifically described with reference to FIGS. 4*a*, 4*b*, 4*c* and 4*d*. The present invention mechanically induces and standardizes the line of movement of the golfer's hips as required for the continuous motion following the fixed posture for performing addressing involving the backswing, downswing, impact and finishing portions of the swing, thereby making the golfer learn the correct posture by repeatedly performing the motion.

Figure 4A:
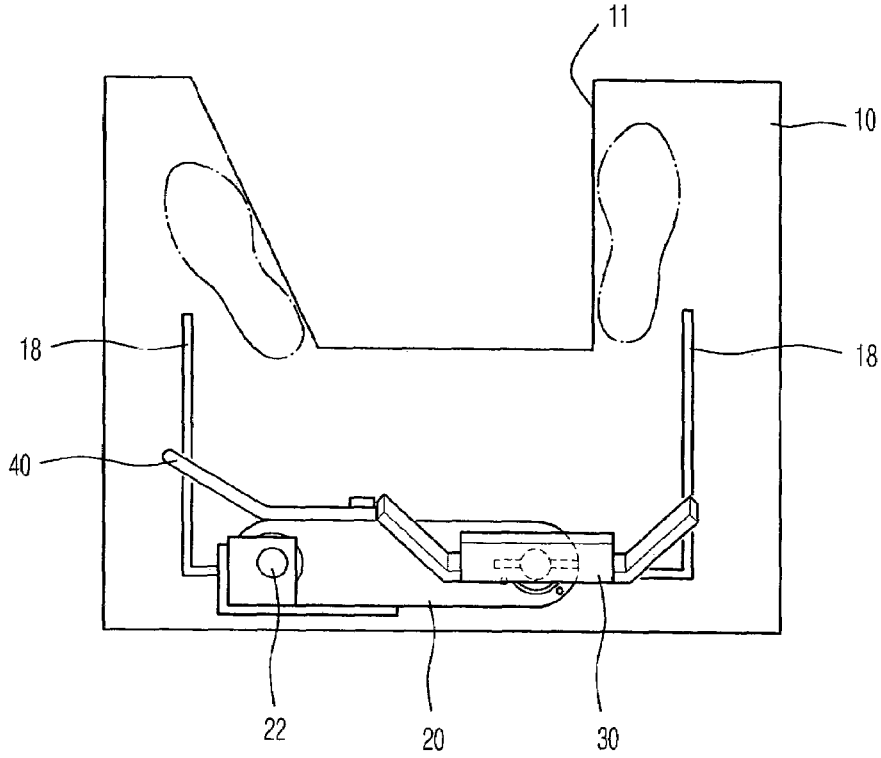

In FIG. 4*a*, the first position of the support 30, illustrated with a solid line, is the addressing of the ball. The pivot arm 20 is felt and known by a contact through the first stopper 16*a*, and based on that, the addressing of the ball posture is taken.

Figure 4B:
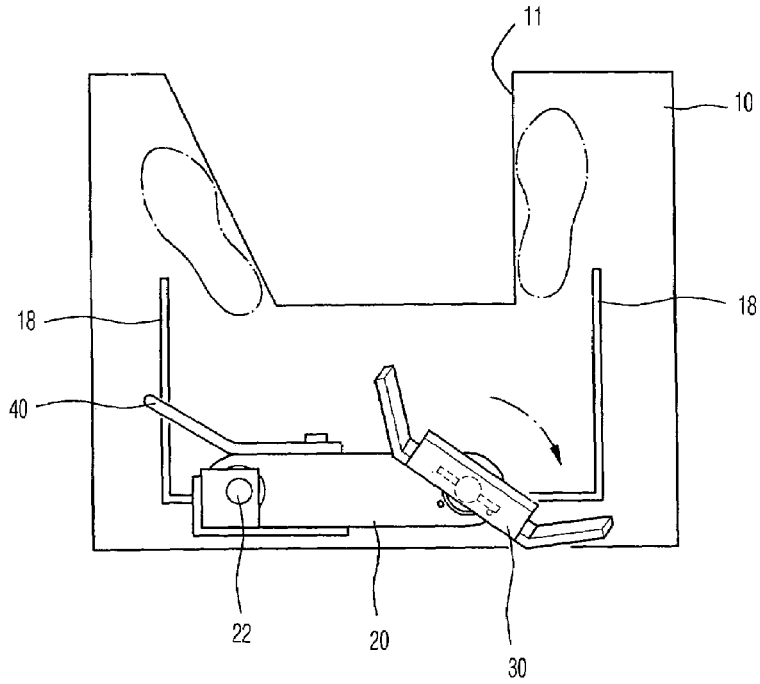

When the backswing is performed from the addressing posture, the hips of the golfer are rotated to the right, wherein the support 30 is rotated clockwise at a predetermined angle to turn the hips of the golfer at a predetermined angle so as to take the back swing posture at the second position, as shown in FIG. 4*b*. The angle of rotation of the support 30 is limited within the predetermined angle by the first brake pin 24*a*.

Figure 4C:
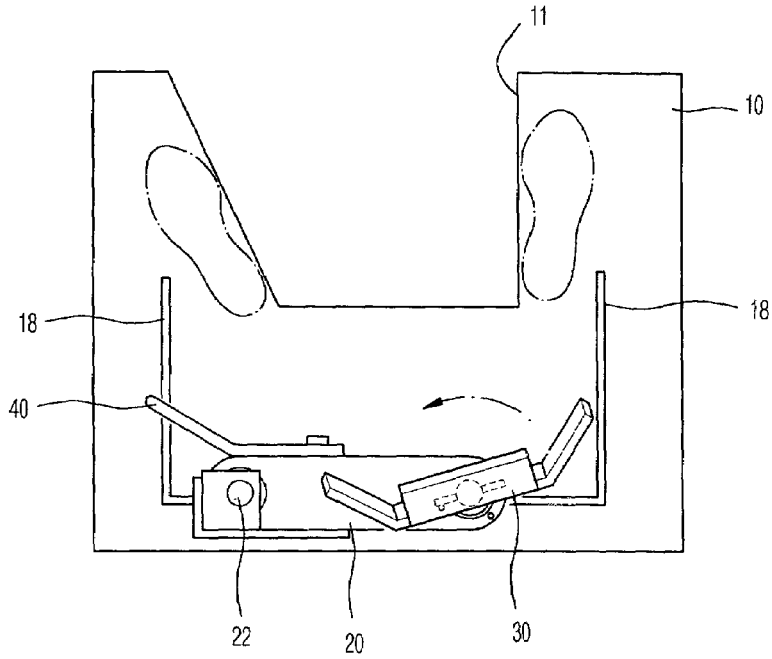

When the downswing is continuously performed following the backswing posture of the second position, the pivot arm 20 is rotated to its own position as above and the support 30 is rotated counterclockwise at a predetermined angle, opposite to the above, so that the hips of the golfer are turned to have the form at the third position in FIG. 4*c*. The support 30 is stopped by the second brake pin 24*b* and concurrently the portion between the left hip and thigh of the golfer touches the auxiliary support 40, thereby completing the motion at the third position for the impact posture.

Figure 4D:
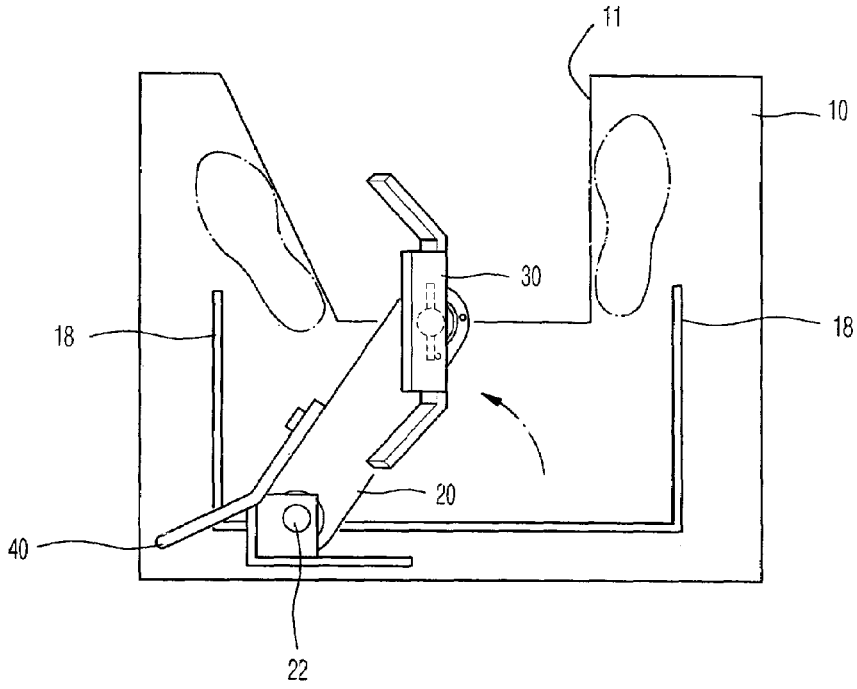

At the same time of arriving at the third position (impact posture), the pivot arm 20 is pivoted counterclockwise by a pushing force applied to the auxiliary support 40, that is, the counterclockwise pushing force is applied to the portion between the left hip and thigh of the golfer, thereby causing the continuous movement to the fourth position shown in FIG. 4*d*. Then, the pivot arm 20 revolving about the support 30 is stopped by the second stopper 16*b*, and the support 30 is rotated counterclockwise at a predetermined angle to position the hips of the golfer to be perpendicular to the direction of flight of the base to complete the finish motion. The rotation of the support 30 is limited by the second brake pin 24*b*.

When the swing motion is completed in the above manner, the golfer waits next training sequence by returning the training machine to the state of FIG. 4*a*.

In the golf training machine according to the present invention, when both of the right and left knees of the golfer take the aforementioned posture at an appropriate position relative to the pillar 12, the control bar 18 is provided for preventing and restricting the knees from being spaced more than necessary, thereby performing more stable motion.

The present invention achieves training for posture correction of the addressing posture for addressing the ball and the backswing, downswing, impact and finish motions, by continuously and repeatedly training for the first, second, third and fourth positions as described above.

The golf training machine according to the present invention has the effect of not only providing the addressing of the ball but also an accurate and stable swing being performed, and therefore, the line of and distance of flight are improved, by maintaining the desired form and posture through a direct and mechanical frame provided by the training machine as a predetermined structure, and by causing the motion to be learned by the golfer through the continuous, consistent and repeated training, so that the golfer remembers the correct addressing of the ball and/or correct swing.

Further, the present invention has the excellent merit by providing the manufacturing of and distributing of the training machine which is movable, and moreover, has the effect of standardization of the training.

While the present invention has been particularly shown and described with reference to exemplary embodiments thereof it will be understood by those of ordinary skill in the art that various changes in form and details may be made therein without departing from the spirit and scope of the present invention as defined by the following claims.

The invention claimed is:

1. A golf training machine for providing posture correction for addressing a golf ball and/or training of a golf swing, comprising:

a supporting body including a plate and a vertical pillar arranged on the plate;

a pivot arm which is rotatable at one end around a shaft at an upper end of the pillar;

a support, rotatably attached at another end of the pivot arm, for rotating and supporting of the hips of a golfer; and an auxiliary support located at one side of a front of the pivot arm for supporting a side of the hips of the golfer; and wherein the support for rotating and supporting the hips of the golfer provides a line of movement of the golfer through positions by rotation thereof and the rotation of the pivot arm providing posture correction for addressing of the ball and a swinging motion;

the pillar comprises a first member and a second member, and the second member is movable inward or outward from the first member such that a length of the pillar is extended or contracted in length to control a height thereof and comprises an attachment for setting the height of the pillar, the pivot arm is pivotable between positions within a radius of rotation of the support and further comprises first and second brake pins for limiting rotation of the support; and the auxiliary support comprises a supporting side attached to the front of the pivot arm by an attachment for fixing the auxiliary support to the pivot arm to prevent relative movement therebetween and a holding side extending beyond and outward from the front of the supporting side for supporting one side of the hips of the golfer.

2. The golf training machine according to claim 1, wherein the auxiliary support comprises a slot, for controlling the position of the auxiliary support according to a golfer's physical characteristics.

3. The golf training machine according to claim 1, wherein the upper end of the pillar further comprises first and second stops for controlling an initial alignment position and a maximum rotation of the support.

* * * * *